US006763774B1

(12) United States Patent
Ranieri et al.

(10) Patent No.: US 6,763,774 B1
(45) Date of Patent: Jul. 20, 2004

(54) ACTIVE DECK SUSPENSION SYSTEM

(75) Inventors: Keith P. Ranieri, Edgewater, FL (US); Ronald M. Berman, Post Orange, FL (US); Scott D. Wood, Bar Harbor, ME (US); Richard J. Garelick, Minneapolis, MN (US); C. Jack Hauck, Inver Grove Heights, MN (US); Michael G. Stoddard, St. Paul, MN (US)

(73) Assignee: Boston Whaler, Inc., Edgewater, FL (US)

( * ) Notice: Subject to any disclaimer, the term of this patent is extended or adjusted under 35 U.S.C. 154(b) by 0 days.

(21) Appl. No.: 10/361,954

(22) Filed: Feb. 10, 2003

(51) Int. Cl.[7] ..... B63B 25/08
(52) U.S. Cl. ..... 114/76; 114/191
(58) Field of Search ..... 114/75, 76, 85, 114/191

(56) References Cited

U.S. PATENT DOCUMENTS

| | | | | |
|---|---|---|---|---|
| 950,871 A | * | 3/1910 | Schmidt | 114/65 R |
| 2,466,164 A | | 4/1949 | Evans | |
| 2,600,518 A | | 6/1952 | Ruth | |
| 2,617,377 A | | 11/1952 | Evans | |
| 3,998,176 A | | 12/1976 | Stout et al. | |
| 4,337,715 A | | 7/1982 | de Pingon | |
| 4,477,045 A | | 10/1984 | Karasawa et al. | |
| 4,930,435 A | | 6/1990 | Newman | |
| 5,207,408 A | | 5/1993 | Burg | |
| 5,348,265 A | | 9/1994 | Burg | |
| 5,810,125 A | | 9/1998 | Gezari | |
| 6,176,190 B1 | | 1/2001 | Ozga | |
| 6,182,596 B1 | | 2/2001 | Johnson | |

FOREIGN PATENT DOCUMENTS

| | | | | |
|---|---|---|---|---|
| JP | 55076787 A | * | 6/1980 | B63B/15/00 |

* cited by examiner

*Primary Examiner*—Jesus D. Sotelo
(74) *Attorney, Agent, or Firm*—Malin, Haley & Dimaggio, P.A.

(57) ABSTRACT

An active deck suspension system for use in marine vessels having a hull and an operator deck. A custom chassis includes pneumatic cylinders which absorb impact forces acting upon the boat hull or suspension deck, and also includes auxiliary emergency jacks. The chassis includes an upper support member which is affixed to the suspension deck, and a lower base support which is complementary to, and mates with, the bottom of the hull. The suspension deck will deflect, in a controlled manner, upon the boat encountering impact forces created by rough seas, or the like. The system includes control circuitry and constantly monitors the suspension deck to automatically compensate for load forces, and thereby provides a substantially improved occupant ride.

12 Claims, 13 Drawing Sheets

ACTIVE DECK SUSPENSION SYSTEM

BACKGROUND OF THE INVENTION

1. Field of the Invention

The present invention relates to a deck assembly for marine vessels, and more particularly to an active deck suspension system which incorporates impact force dampeners or shock absorbers beneath an area of the occupant deck, to reduce or eliminate the effects of such forces or vibrational fatigue and provide for a more comfortable and stable ride.

2. Description of Related Art

Hull and deck designs in the marine industry have heretofore attempted to address the problem of reducing the deleterious effects of impact forces acting upon the hull as the vessel is cruising in high seas, rough or choppy waters. However, prior attempts to minimize the effects of wave force energy, and provide a more comfortable ride for the vessel operator or passengers involve overly complicated designs which are faulty in application and/or impractical from the standpoint of engineering designs and financial considerations. Although the prior art has addressed the general principles concerning stabilizing inner hulls or decks through the use of cushioning means or other dampeners attempting to reduce undesirable shock forces encountered largely by the outer hull, the industry heretofore has failed to provide an improved, dynamic, and effective suspension system.

The prior art has attempted to solve these problems in a variety of ways. For example, U.S. Pat. No. 6,182,596 issued to Johnson, is entitled "System for Minimizing the Effects of Shock and Vibration in a High Speed Vessel," and teaches of a shock absorbing system designed for inclusion in high speed Cigarette boats, and incorporates a complete inner hull, which is stabilized through a complicated damper and spring linkage assembly placed about the perimeter of the inner hull. There are numerous spring and damper support mechanisms secured to the side walls of the outer hull, attempting to cushion both vertical motion, as well as translational motion. The inner hull constitutes a "superstucture," which is complete in and of itself, and is essentially a doubled-hull vessel, as opposed to a conventional hull and deck construction. Further, the '596 system includes numerous torsion bar assemblies which are inaccessible between the two (2) hulls.

U.S. Pat. No. 6,176,190 issued to Ozga, is entitled "Suspension System for a Speedboat," and attempts to provide dynamic isolation of the deck by incorporating a series of dampeners and multi-axes pivot mountings to account for pitch, yaw, and roll motion. Ozga '190 also discloses, in one embodiment, a complete inner hull for a mono-hull vessel, and also has application for catamarans.

U.S. Pat. No. 5,348,265 issued to Burg, is entitled "Air Cushion Supported Secondary Structure," and teaches of a pressurized gas cushioning system wherein an enormous internal passenger cabin is supported in its entirety by pressurized gases. A complicated blower and duct assembly is designed into the outer vessel, and supplies gas through the sealed duct and chamber system. The internal cabin is supported in a secondary manner through actuators and pivoting connection points.

U.S. Pat. No. 2,617,377 issued to Evans, is entitled "Boat Construction," and discloses an arcane design which incorporates a central, gyroscopic wheel which supports a deck segment. The deck can move with respect to the hull via the gyroscope, and a complex linkage system which includes universal joint pivot points, roller assemblies, springs, and cables.

The prior art, therefore, fails to provide a dynamic deck suspension assembly, particularly for a conventional hull and integral deck, which can be readily incorporated into current manufacturing methods and vessel designs, is structurally sound, operationally efficient, and cost effective. Further, such a system is needed which constantly monitors loads placed upon the select deck area, and automatically compensates for impact forces acting upon the hull.

Accordingly, what is needed in the marine industry is an improved active deck suspension system which overcomes the problems associated with complex and impractical mechanical designs which require extensive alterations in vessel construction, provide numerous components which are subject to extensive maintenance or component failure in marine conditions, or are otherwise impractical. The deck suspension area must not impede general performance of the vessel when operating at relatively high speeds or in rough seas, must be integral with remaining, rigid deck sections, and must be easy to install and maintain. It is, therefore, to the effective resolution of the aforementioned problems and shortcomings of the prior art that the present invention is directed. However, in view of the deck designs in the marine industry in existence at the time of the present invention, it was not obvious to those persons of ordinary skill in the pertinent art as to how the identified needs could be fulfilled in an advantageous manner.

SUMMARY OF THE INVENTION

The present invention contemplates an improved and modified dynamic deck suspension platform, which is integral with a conventional boat deck, mounted within a hull. A boat hull generally includes a bottom section which can be of a semi-V or deep-V design, although a hull of any shape can practice the instant invention. The vessel further includes sidewalls, gunnels, a fore or bow area, as well as an aft section and transom.

The improved design includes a chassis or frame which can be discontinuous, and is mounted in the hull in a generally vertical plane, and transversely positioned with respect to the longitudinal axis of the vessel. In one embodiment, the chassis constitutes a mechanical insert, and supports dampening cylinders or torsion springs which act as shock absorbers, on opposite ends of the chassis. At its uppermost section, the chassis includes an essentially horizontal beam which supports the deck section of the instant invention. At its lowermost section, the chassis incorporates a geometric shape which matches the desired hull shape, and in certain embodiments is of a semi-V design. The dampening means can be mounted in a generally upright position, between the upper and lower sections of the chassis.

Additionally, torsion control plates are pivotally and hingedly mounted about the center of the chassis, between the dampeners. This torsion control means maintains the chassis components in a generally coplanar position, and limits movement of the upper section to vertical movement. That is, the torsion control means prevents side-to-side (or horizontal) movement, as well as translational or rotational movement of the upper section, which in turn prevents such movement of the suspended deck area.

Emergency actuators, or support jacks, are available at the option of the operator, or in the event of failure of the primary dampening means. The emergency actuators maintain the suspended deck area in an upright position, flush with the main vessel deck, and constitute a lockout feature. The actuators could be manually operated as well.

In a particular embodiment, pneumatic cylinders are used as the dampeners or shock absorbers, and a component board provides the air compressor, reserve air tank, pressure monitoring gauges, and system control electronics. The system control circuitry includes a plurality of reed switches and solenoids, timers, and enablement switches. The system includes electronic components and circuitry, electromagnetic control components, and dynamic monitoring, such that the loads or shock forces acting upon the suspended deck area are constantly monitored, and the system automatically adjusts the pressure independently in the pneumatic cylinders, and the expansion or retraction of the cylinder rods in response thereto. Thus, the system automatically compensates for impact forces or wave energy acting upon the hull or deck section, and maintains the resistive forces or "stiffness" of the suspended platform in a desired condition.

The foremost section of the suspended deck area is securedly attached to the top of the chassis insert. The aft section of the suspended deck area is attached to the adjacent deck section using a hinge or other pivotable mechanism. In alternative embodiments, a plurality of the disclosed chassis assemblies could be utilized at both fore and aft suspended deck areas. In a preferred embodiment, with respect to a center console boat, the suspended deck area extends from the transom to the base of the center console, and can accommodate any type of seating design, helm chair, leaning post, or other desired deck attachment.

In alternative designs, hydraulic cylinders, compression spring shock absorbers, or similar electrical, mechanical, or emerging technology compression assemblies can be incorporated into the instant invention and chassis members. The overall design of the entire system must be compatible with conventional boat hulls and rigid deck sections, manufacturing methods, and technology. The design must provide superior performance, and yet be relatively unobtrusive, such that it does not constitute a substantial mechanical or electrical hindrance, awkward assembly, or otherwise impede the operation of the boat in marine conditions. This invention provides a clean and clever solution to the problems set forth above, is seamless in terms of integrating the system into conventional boat construction and manufacturing techniques with minimal variance, is financially sound, and easy to service.

In accordance with the instant invention, it an object thereof to provide an improved active deck suspension system for use on marine vessels, which reduces or eliminates impact forces or wave energy acting on the boat hull.

It is a further object of the instant invention to provide an active deck suspension system which includes a superior mechanical and electromechanical design, is operationally efficient, and is easy to maintain.

It is a further object of the instant invention to provide an active deck suspension system which does not interfere with the operation or performance of the vessel, and is fully integrated into a conventional occupant deck.

It is a further object of the instant invention to provide an active deck suspension system which is cost-effective and of a superior manufacturing design.

It is a further object of the instant invention to provide a deck suspension system which is dynamic, constantly monitors load forces acting upon the suspended deck, automatically compensates for such forces, and regulates the stiffness of the related deck area.

Still another object of the present invention is to provide an active deck suspension system which is compatible with existing hull and boat designs, and can be incorporated into original equipment or, alternatively, retrofitted to existing boats.

A further object of the present invention is to provide a dynamic deck suspension assembly which includes all of the above mentioned features and objects to provide a substantially superior design, eliminating the problems encountered by prior devices, and generally solving problems associated with operating vessels in rough marine conditions.

These and other objects, advantages, and features of this invention will become clear as this description proceeds hereinafter. The invention accordingly comprises the features of construction, manufacturing methods, engineering designs and components, the interrelationship thereto, combination of elements, and arrangement of parts that will be exemplified in the description set forth hereinafter.

In accordance with these and other objects which will become apparent hereinafter, the instant invention will now be described with particular reference to the accompanying drawings.

DETAILED DESCRIPTION OF THE PREFERRED EMBODIMENT

Figure 1:
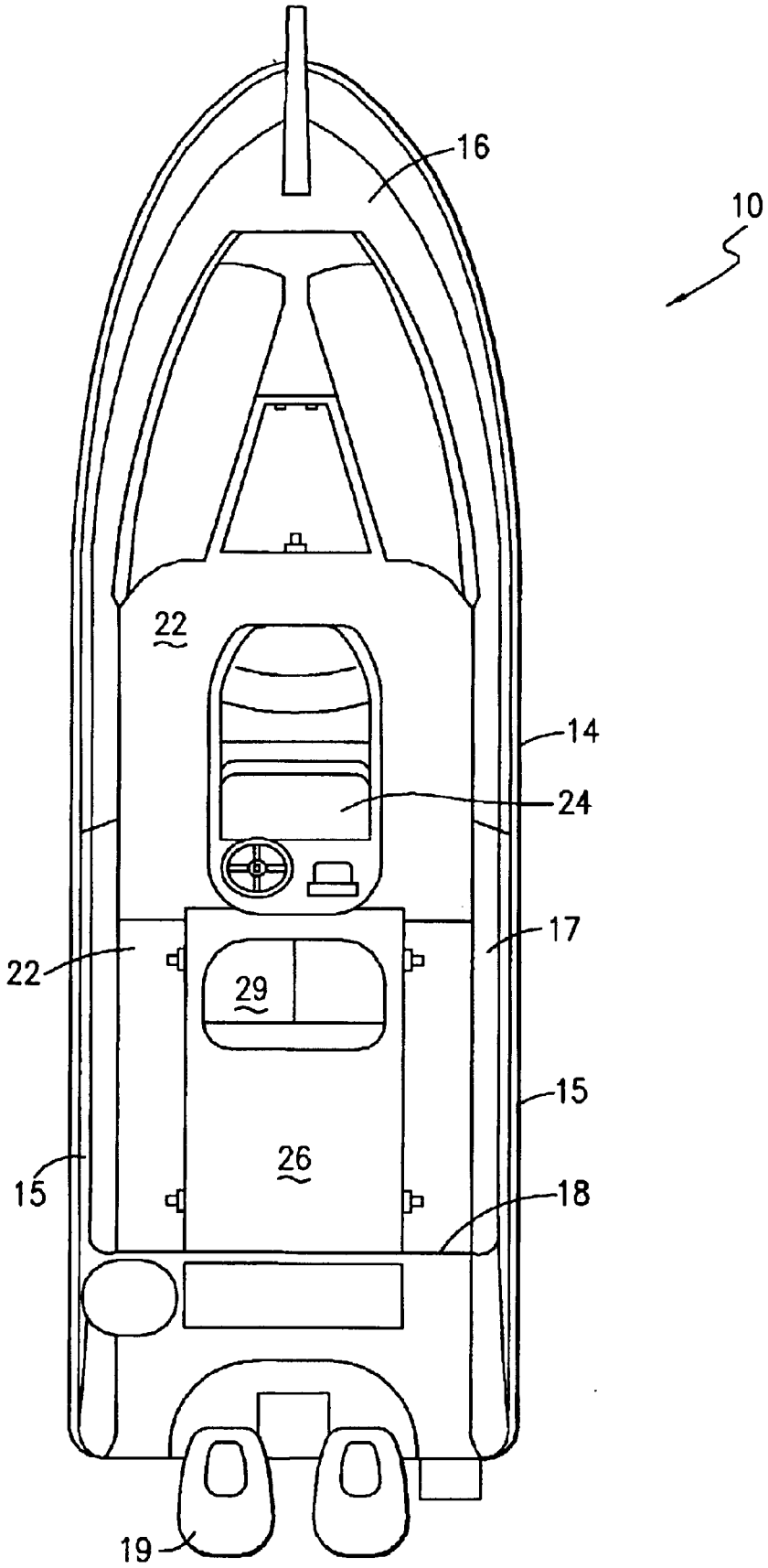
FIG. 1 is a top plan view of a boat and deck assembly incorporating the instant invention.

Turning to FIG. 1, a top plan view of a boat 10 is illustrated, including hull 14, bow area 16, external sidewalls 15, gunnels 17, and transom 18. This particular boat includes outboard motors 19 and conventional deck 22. A center console 24 is depicted in conjunction with the active suspension deck 26. However, it is to be appreciated that any boat type or design could incorporate the instant invention, such as bow riders, cabin cruisers, etc. Suspension deck 26 is shown in a rectangular, platform configuration, however, as will be appreciated by one of ordinary skill in the art, any particular shape can be utilized. Finally, helm or passenger seats 29 are shown as mounted on top of suspension deck 26.

Figure 1A:
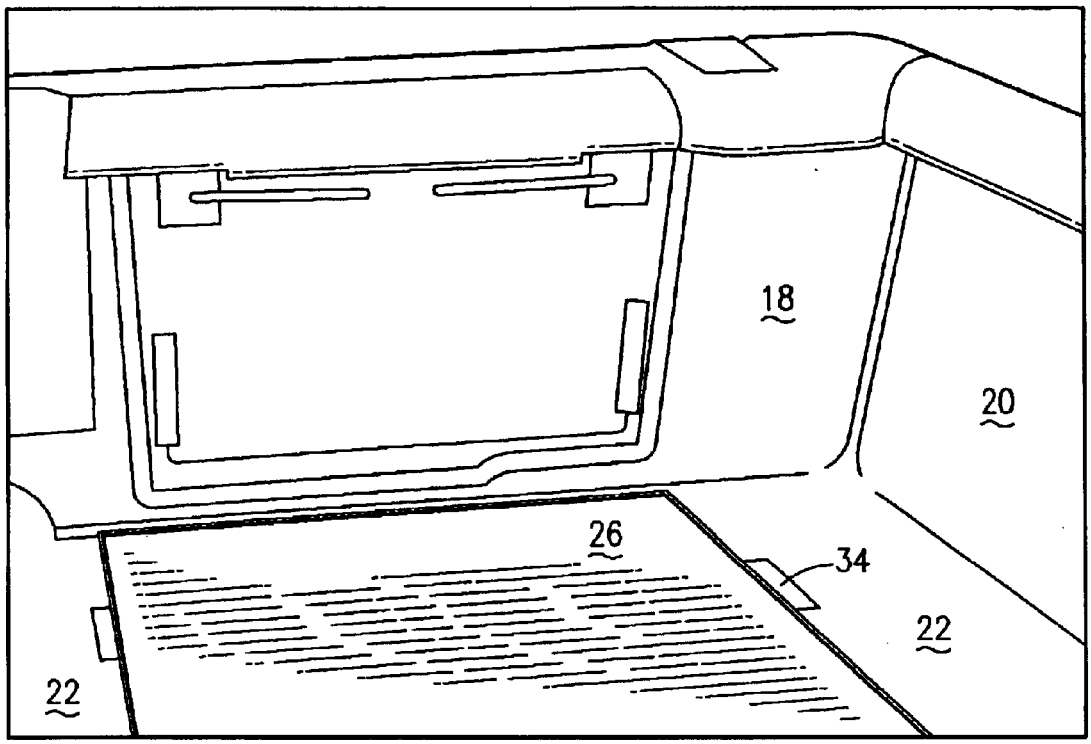
FIG. 1A is a perspective, rearward view of the aft/transom area of a vessel incorporating the instant invention.

With reference to FIG. 1A, a perspective view of suspension deck 26 is illustrated, along with transom 18 and internal sidewall 20. In this particular embodiment, suspension deck 26 is seen as terminating in the immediate area of transom 18. Conventional deck 22 is shown, which is manufactured and assembled pursuant to current industry practices and typical methods, such that deck 22 is permanent, rigid, and immovable. As will be appreciated hereinafter, suspension deck 26 is hingedly attached to the conventional deck in the transom area, and is suspended for deflecting movement in a controlled manner, at the opposite end toward the console.

Figure 2:
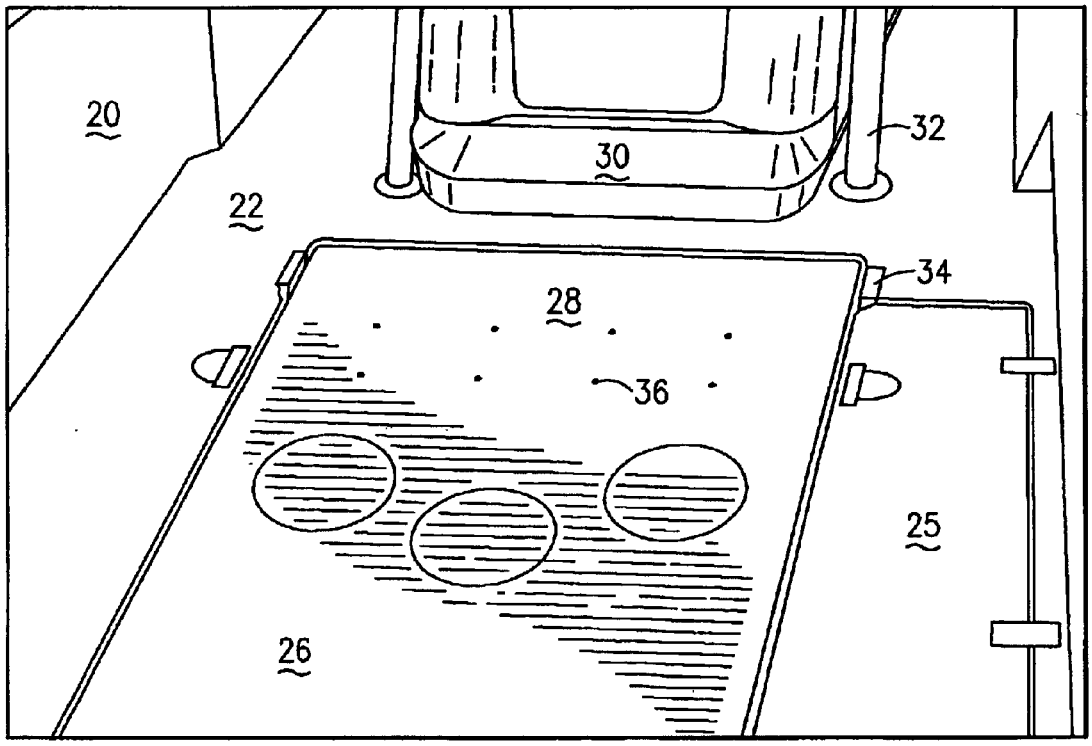
FIG. 2 is a perspective, forward view of the instant invention, illustrating the forward section of the suspended deck in conjunction with a center console.

FIG. 2 illustrates the forward section 28 of the suspension deck, and its proximity to center console base 30. Console base 30 is illustrated as having tower arms or pipes 32 which provide support for the vessel operator, as well as for T-tops, towers, accessory components, or the like. FIG. 2 also depicts the convention deck 22, as well as conventional deck compartment 25, which can constitute a fish or ice box, storage well, or accessory compartment. Spacers 34 provide an interface between the conventional deck 22 and suspension deck 26, and further prevent side-to-side movement of suspension deck 26. Bolts 36 are illustrated, which provide the means for attaching suspension deck 26 to the main suspension chassis.

Figure 3:
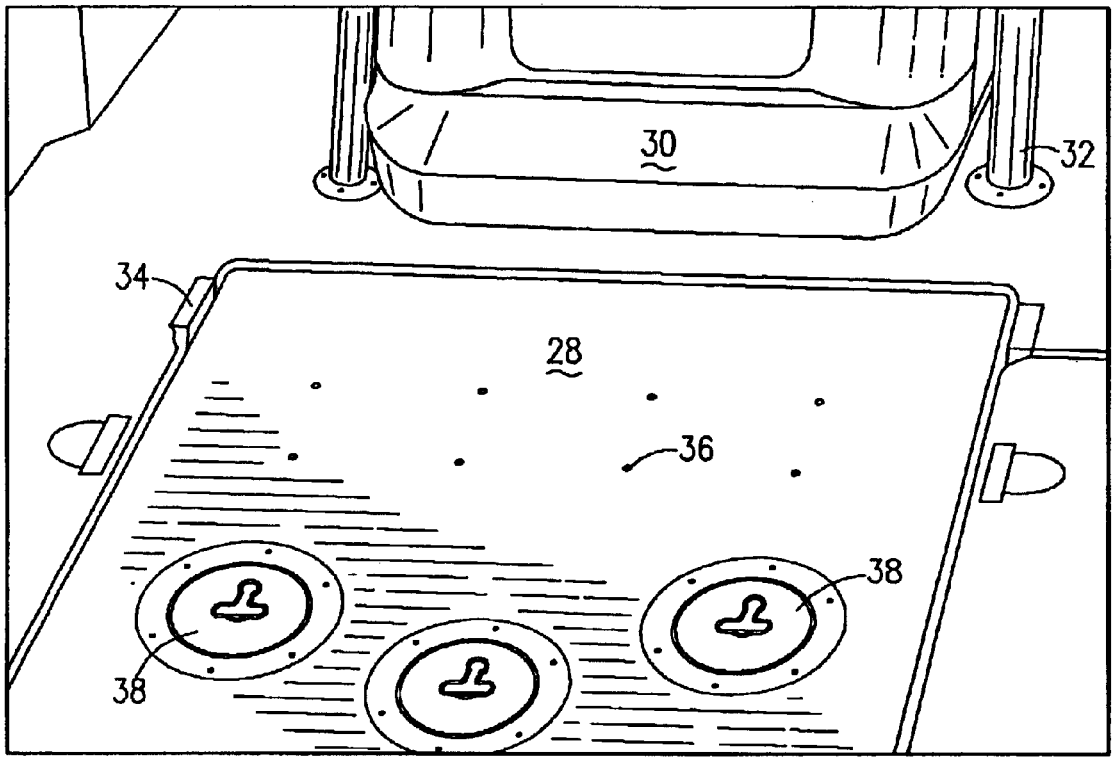
FIG. 3 is an enlarged, perspective view of the invention illustrated in FIG. 2.

FIG. 3 provides an enlarged, partial view of the structure shown in FIG. 2, and further depicts access plates 38 for monitoring or servicing components beneath suspension deck 26.

Figure 4:
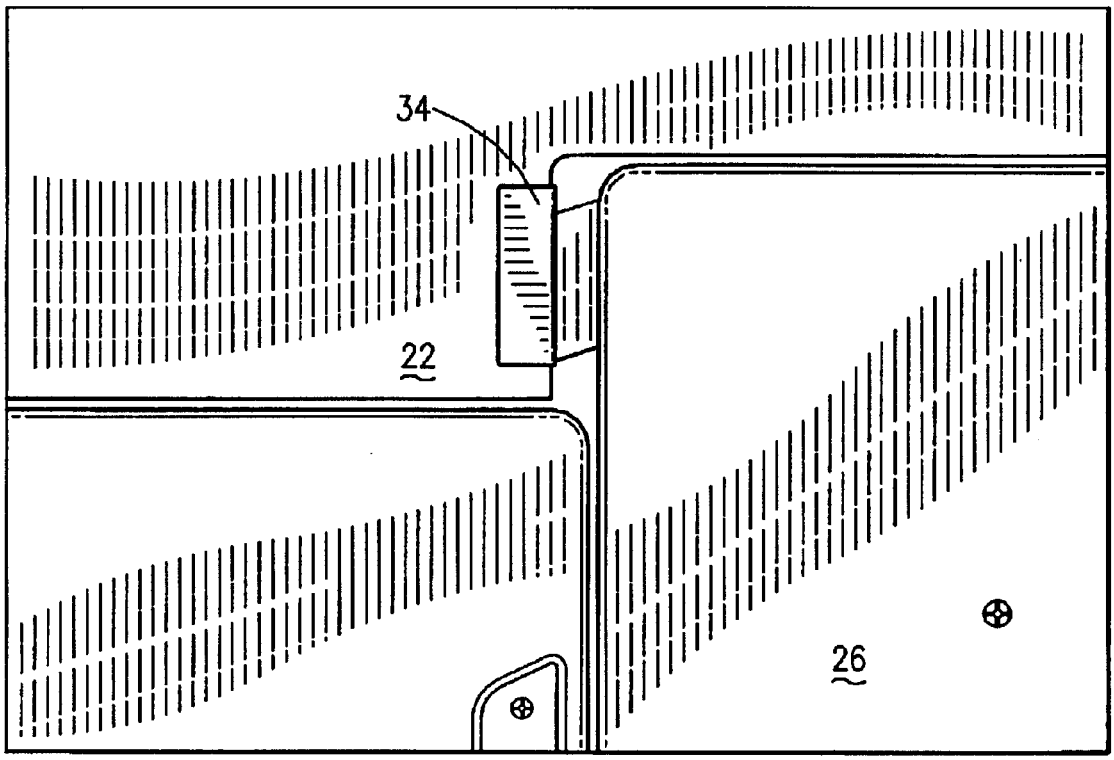
FIG. 4 is a top plan view of a deck section of the instant invention, illustrating the integration of the suspended deck assembly with the conventional deck, and components thereof.

With reference to FIG. 4, the plastic slides or spacers 34 are illustrated at the forwardmost section of the suspension deck 26, and interface with conventional deck 22. The slides can be made of an appropriate low-friction plastic or composite material, and provide a spacer to inhibit and prevent side-to-side movement or binding of the suspension deck, as described above.

Figure 5:
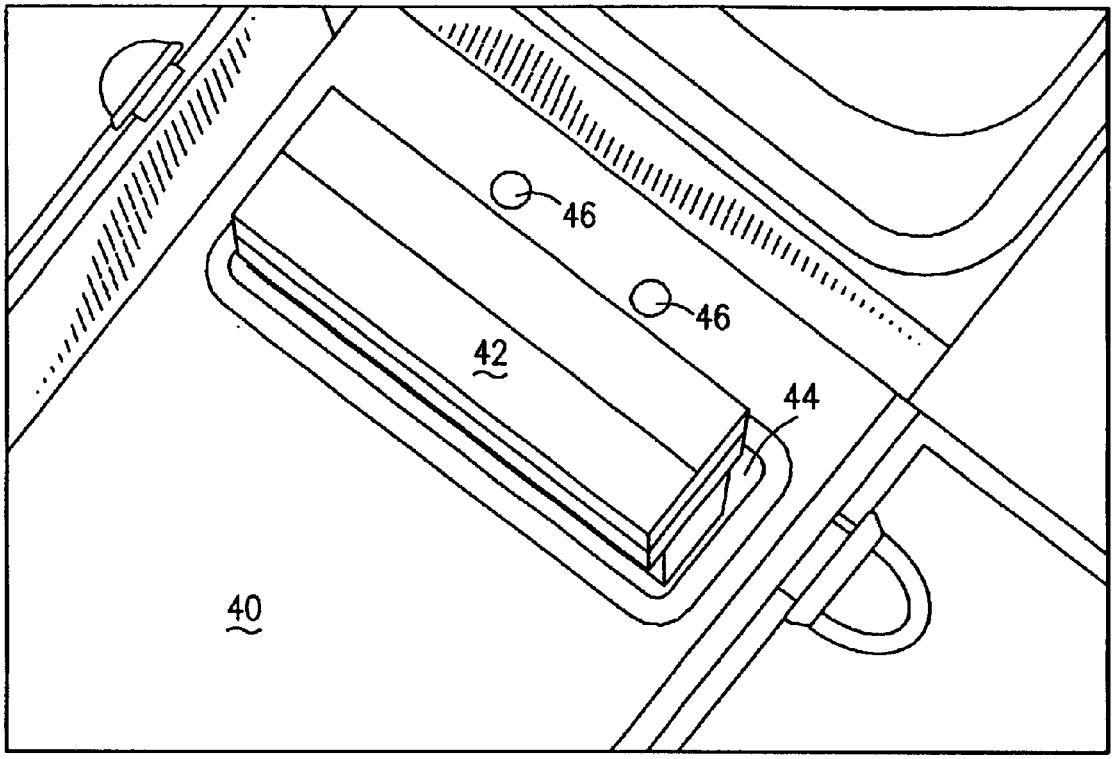
FIG. 5 is a perspective view of the instant invention, illustrating the upper chassis member, with the suspended deck removed.

With reference to FIG. 5, the suspension deck is removed, thereby providing access to water drip pan 40. The uppermost section 42 of the main suspension chassis is illustrated, and shown to be protruding through opening 44 formed in the drip pan. Drip pan 40 further includes apertures 46, which provide water drains to the hull throughholes.

Figure 6:
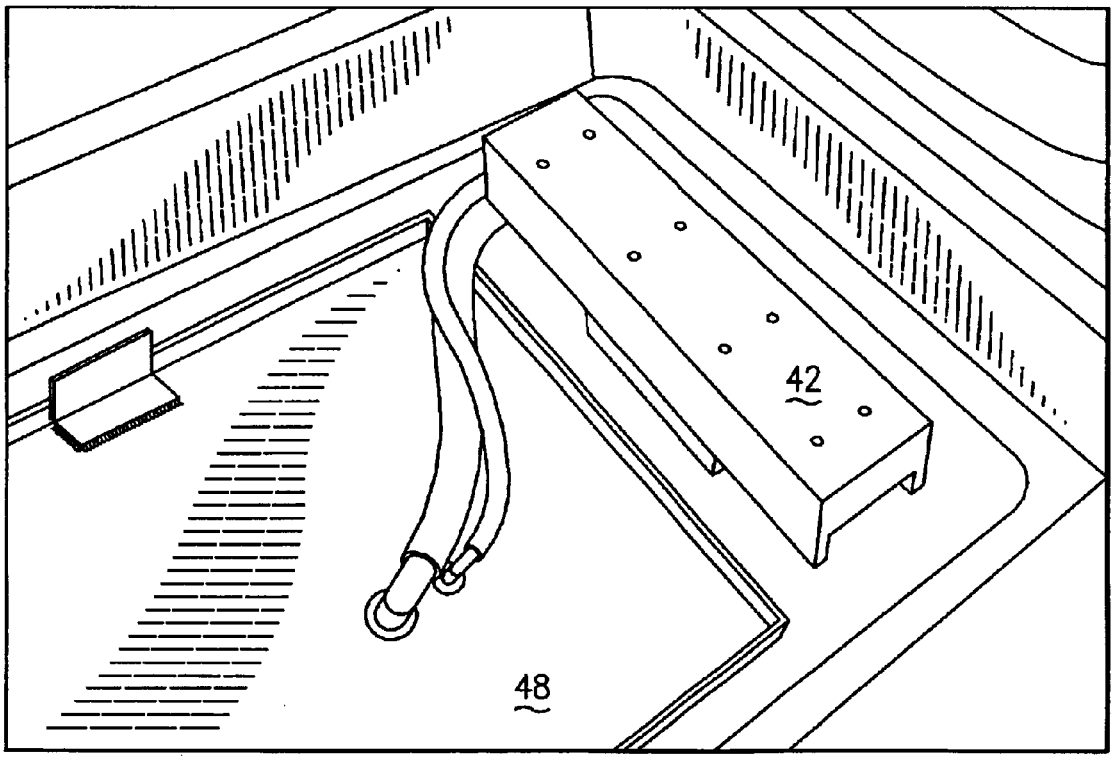
FIG. 6 is a perspective view of the instant invention illustrated with the drip pan removed.

With reference to FIG. 6, the invention is shown with drip pan 40 removed, and shows main fuel tank 48. Upper section 42 of the main suspension chassis is illustrated, and in a particular embodiment is a horizontal beam of a U-shaped, channel cross-sectional design. The beam can be manufactured of any appropriate material, such as stainless steel, structural aluminum, or composite metals, hardwoods, plastics, or combinations thereof.

Figure 7:
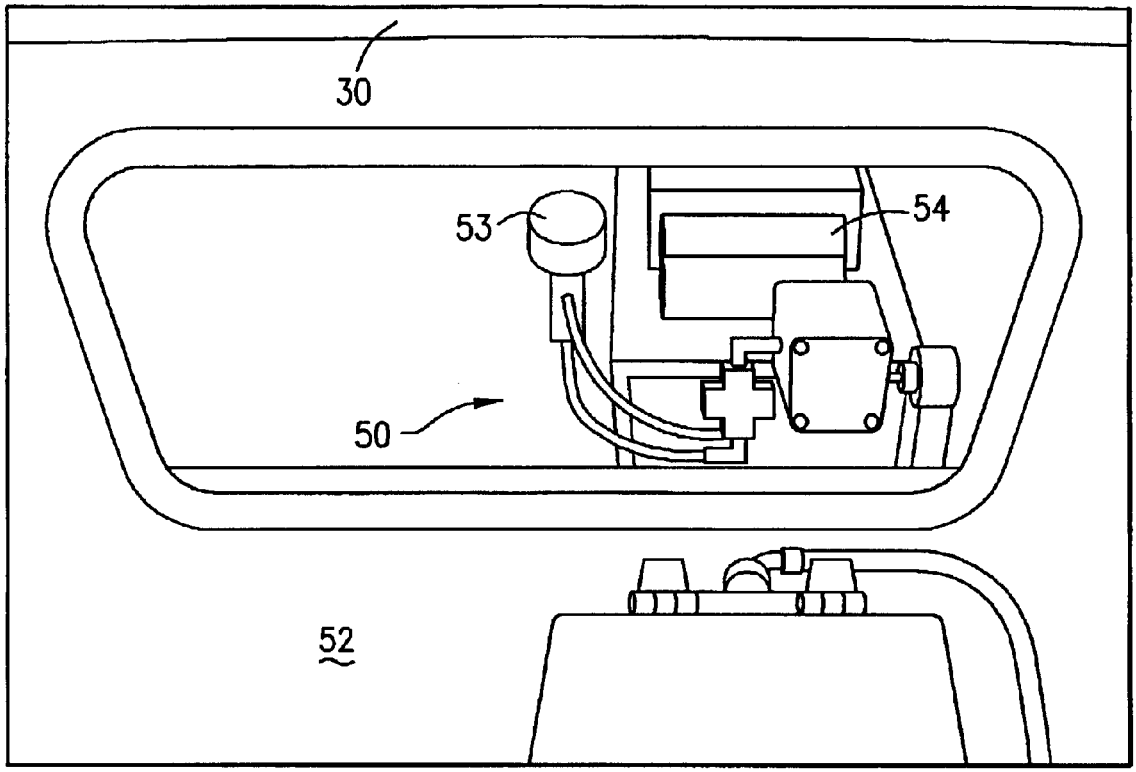
FIG. 7 is a perspective view of the instant invention, illustrating the component board mounted within the console.

FIG. 7 depicts the component board 50 of the system design, which is mounted in compartment 52 below center console base 30. The component board contains pressure regulator 53, compressor 54, and reserve tanks and electrical devices as further described hereinafter.

Figure 8:
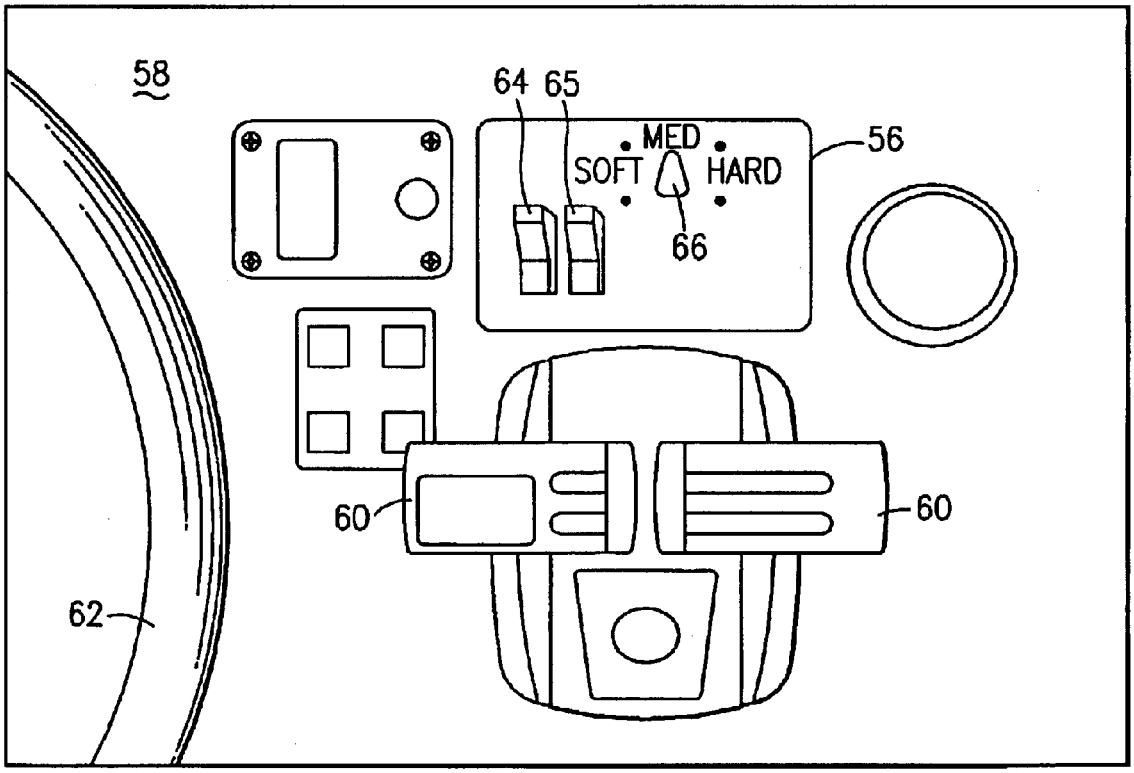
FIG. 8 is a plan view of the instant invention, illustrating the control panel mounted in the console.

FIG. 8 illustrates the control panel 56 of the system, as mounted in a conventional boat instrument panel 58. Engine throttles 60 are shown, as is a partial section of steering wheel 62. The control panel includes on/off switch 64, which enables and supplies power to the circuitry, compressor, and system components.

Switch 65 activates the auxiliary jacks which comprise an emergency lift in the event of failure of the primary dampening means, pneumatic or hydraulic cylinders.

Resistance control switch 66 of the control panel selectively determines the magnitude of deflection of the suspension system, which can be characterized as the "stiffness" of the suspension deck. The instant invention incorporates a continuously adjustable switch, and includes three primary positions relative to one another, a first position being soft, an intermediate position being medium, and an extreme position being firm. The resistance control knob actuates the associated circuitry to increase the resistance of air escaping from the pneumatic cylinders, and thereby increasing the impact or load forces which would be required to deflect the suspension deck.

Figure 9:
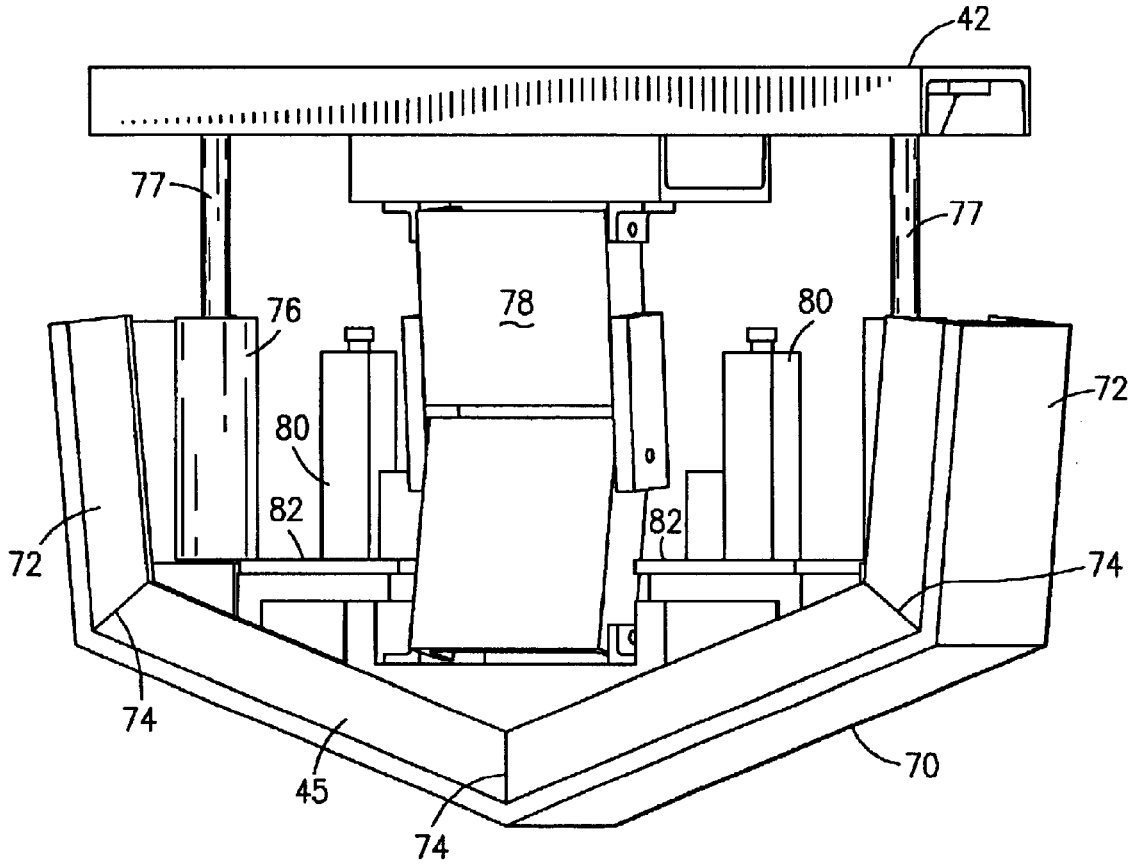
FIG. 9 is a perspective view of the main suspension chassis and associated components of the instant invention, in a generally upright position.

FIG. 9 depicts an embodiment of the suspension chassis having upper horizontal member 42, and lower base support member 45. In an alternative embodiment, the support members are manufactured from channel iron or stainless steel or composite material, and base support member 45 is illustrated as having an external "semi-V" configuration 70, which complements and mates to the corresponding shape of the hull in which the chassis means is mounted. The angled base support member can also incorporate upright stanchions 72, and the individual sections of the base support are secured to one another through welds 74. Further depicted are dampening means 76, torsion control means 78, and auxiliary support members 80.

In the preferred embodiment, dampening means 76 constitute pneumatic cylinders, such that the pressure can be accurately regulated and selectively adjusted by the vessel operator. Alternatively, hydraulic cylinders could be incorporated into the instant invention, as could be compression springs, shock absorbers, or similar compression devices.

The lower section of the suspension chassis, or the base support member, further includes horizontal support surfaces 82 secured to the lower base, to provide a flat mounting surface for the individual dampening means 76 and auxiliary jacks 80. FIG. 9 depicts the chassis in its relatively extended position, with the elevating rods 77 of the pneumatic cylinders extended to their uppermost position.

Figure 9B:
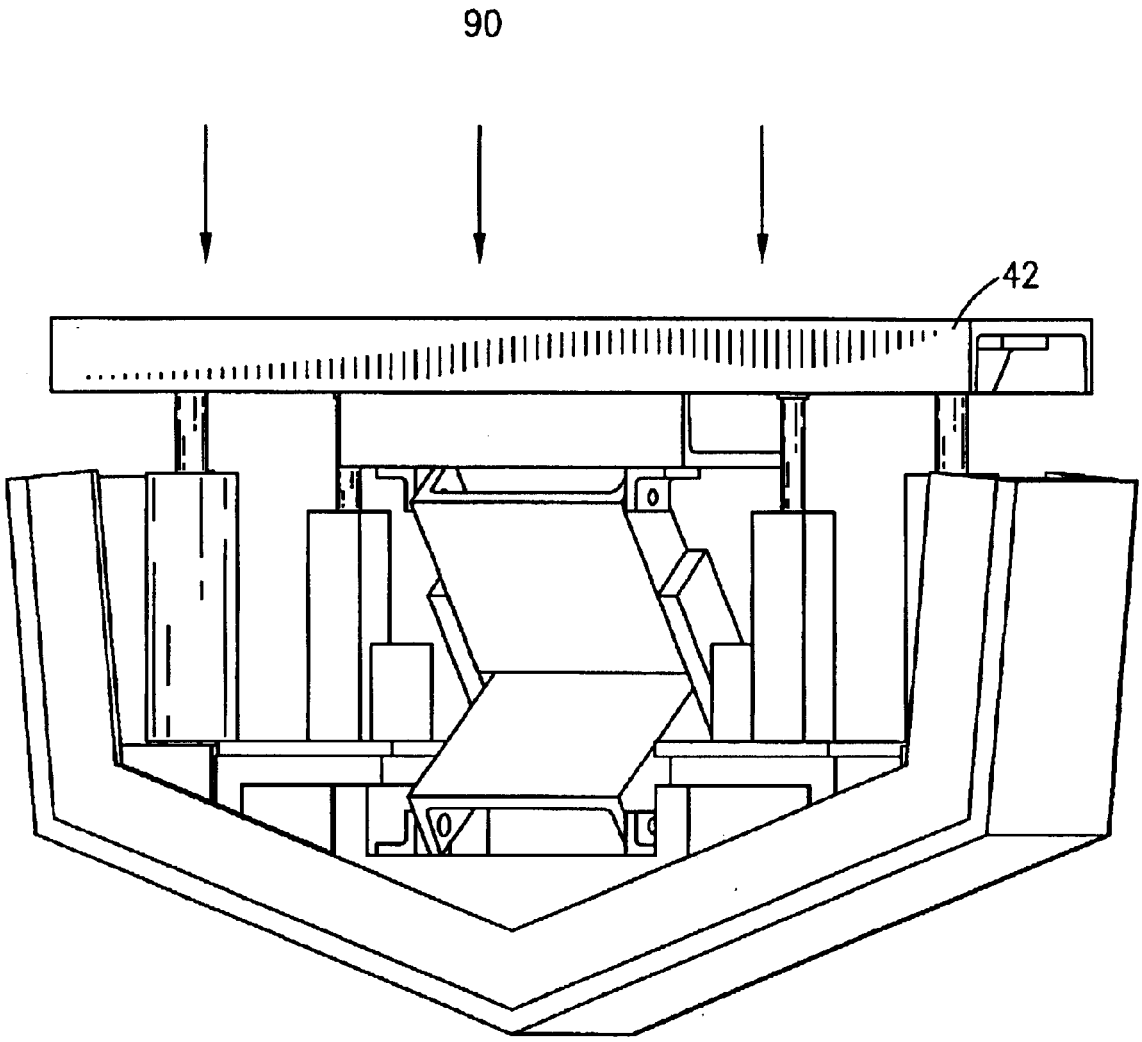
FIG. 9B is a perspective view of the main suspension chassis and associated components of the instant invention, in a generally lowered position.

FIG. 9B depicts the chassis means in a retracted position, in which the chassis beam 42 is lowered towards the bottom of the hull and base support member. As the suspension deck encounters substantial loads through additional weight or, alternatively, as the hull of the boat impacts a wave, the suspension deck would deflect downward in the direction of arrows 90, and encounter the selective resistance of the pneumatic cylinders. After the impact forces have been absorbed, the control mechanisms for the suspension system, as hereinafter described in detail, would return the upper support beam of the chassis to its upright position, flush with the conventional deck.

Figure 9C:
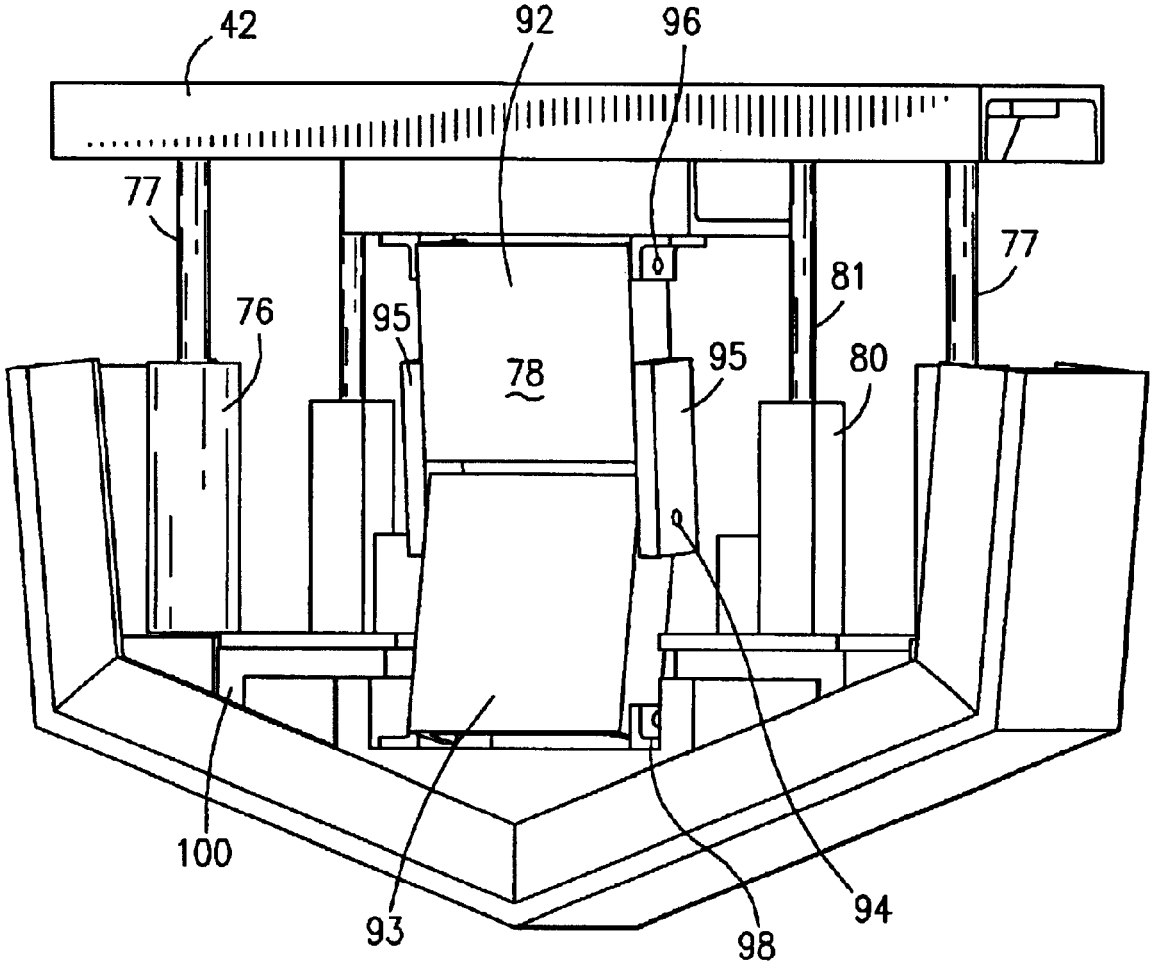
FIG. 9C is a perspective view of the main suspension chassis and associated components of the instant invention, in a generally upright position, with the auxiliary jacks engaged.

FIG. 9C depicts the pneumatic cylinders 76 and rods 77 in their extended position, along with auxiliary support jacks 80 and auxiliary rods 81 also in the extended and outermost configuration.

Torsion control means 78 is shown as having an upper plate 92 and lower plate 93, which are hingedly connected to one another at pivot points 94, in conjunction with support arms 95. Support arms 95 are secured to upper plate 92, and pivotally attached to lower plate 93. Additionally, upper plate 92 is pivotally attached about its sides at points 96 to upper chassis beam 42. Lower torsion control plate 93 is similarly secured and pivotally attached to the base at point 98 and to intermediate housing structure 100. The pivotal attachments can be accomplished using pin or bolt hardware, with appropriate flange and beam members being secured to the two (2) primary chassis frame members, as illustrated.

The design and assembly of the torsion control plates and their pivoting relationship to one another within the chassis, prevent translational, rotational, or side-to-side movement of the upper chassis support beam. The torsion control means is mounted in the center of the chassis, and placed between the damping cylinders, as well as the actuator emergency jacks. The torsion plates and support arms maintain the chassis in a generally coplanar position, along with the mechanical equipment mounted within the chassis.

It is to be appreciated that the chassis can be discontinuous, and in one particular embodiment includes an upper horizontal support, and opposing base, which is mounted within the hull. Further, the individual chassis members could be discrete support plates or mounting frames or, in contradistinction thereto, could have a continuous periphery as a matter of design choice and structural integrity.

Figure 9E:
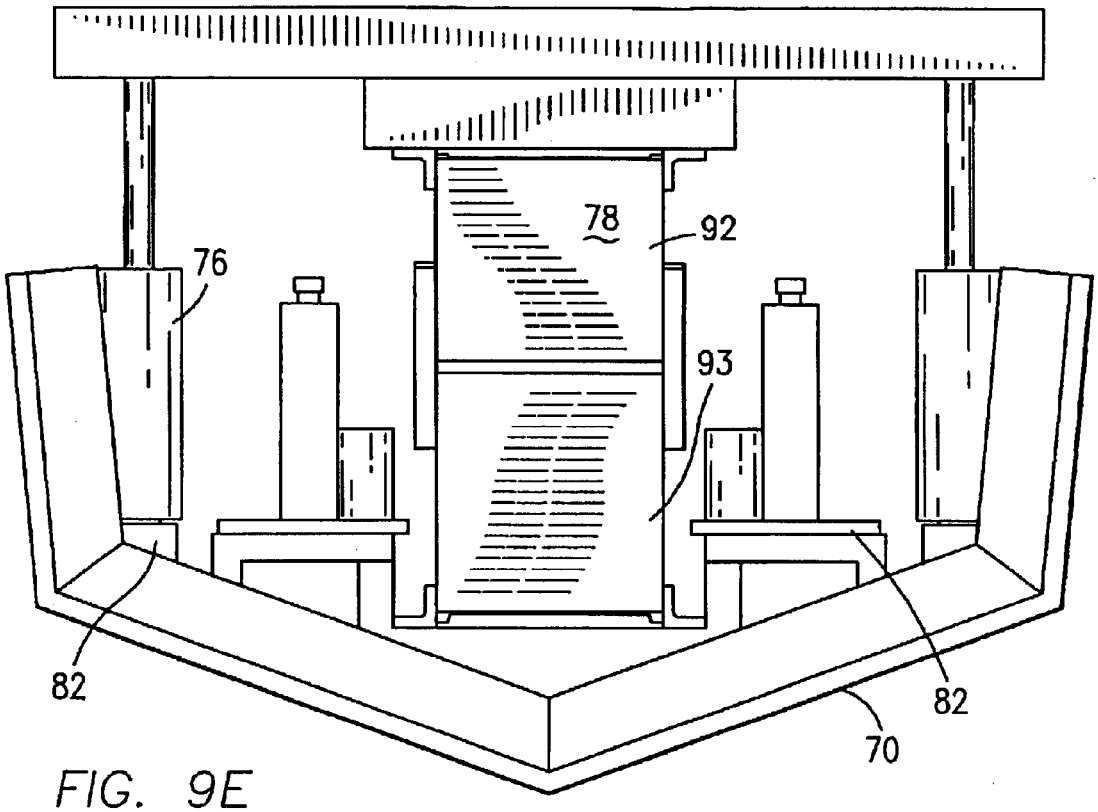
FIG. 9E is a front plan view of the instant invention, illustrating the chassis in its most extended and upright position, with the dampening means engaged, and auxiliary jacks disengaged.
Figure 9D:
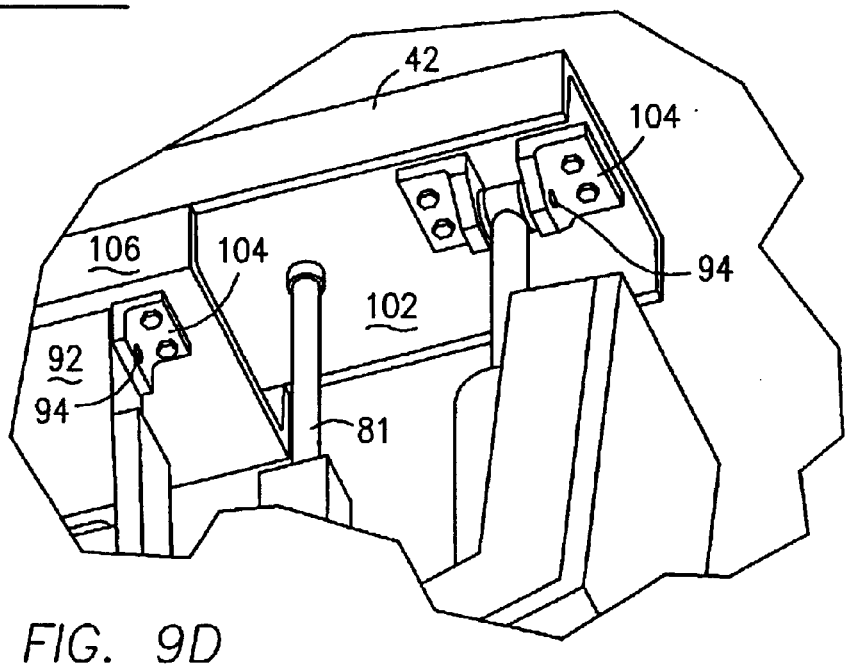
FIG. 9D is a perspective, partial view of the right, uppermost section of the suspension chassis of the instant invention, illustrating mounting and assembly hardware.

FIG. 9D illustrates the underside 102 of beam 42, and the angled flanges 104 which can be used to secure the mechanical components to one another and provide pivot points 94. The upper support plate 92 is secured to an intermediate frame member 106, which is in turn welded or otherwise permanently secured to beam 42.

FIG. 9E represents the pneumatic cylinders and torsion control means 78 being extended to their extreme position, such that the plates 92 and 93 are in an essentially vertical plane.

FIG. 9E is a front plan view of the instant invention, and depicts the horizontal support surfaces 82, which are structurally supported by base member 70, and provide the floor for positioning the pneumatic cylinders and emergency jacks.

The height of the suspension deck, and the angular deflection of the platform, is controlled by sensors located on the pneumatic cylinders. The sensors can be reed switches located along the length of the cylinder, which are triggered by a magnet on the piston head. If the deck is not at its topmost height flush with the fixed deck, the system automatically increases the pressure in the air cylinders to accomplish this. Although this is one method of automating the deck height, there are other ways of accomplishing this. One skilled in the art would appreciate equivalent devices to sense actuation of the piston, such as electronic devices, optical instruments, or electromagnetic components.

It is also envisioned that deflection sensors may be mounted on, or near, the suspension platform itself. Upon downward movement, the sensor detection circuitry would enable the compressor to likewise increase cylinder pressure, or activate an alternative compression device.

Figure 10:
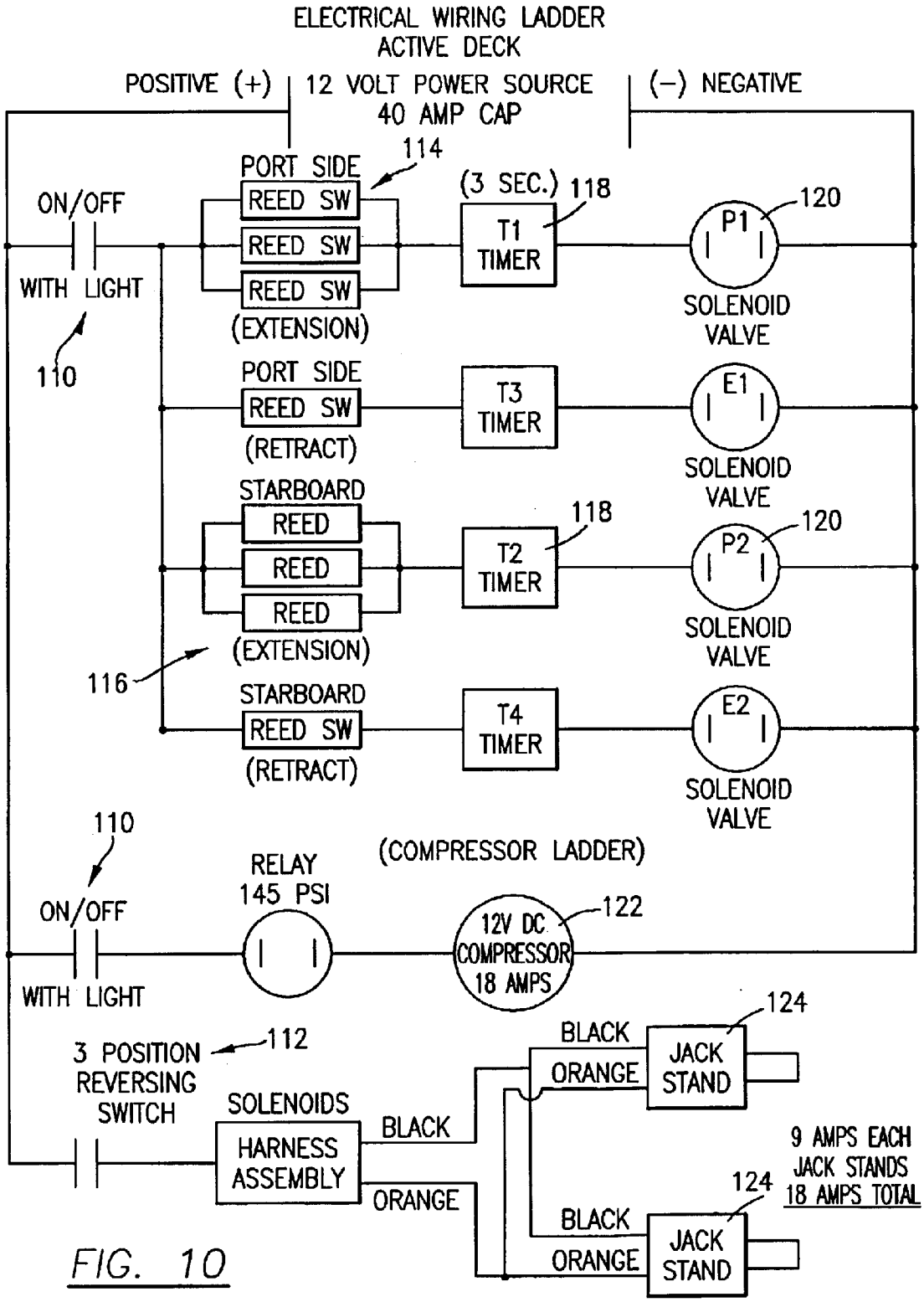
FIG. 10 is an electrical wiring schematic for the electronic and electromagnetic components of the instant invention.

FIG. 10 depicts the schematical representation of the electric wiring for the control system. On/off switches 110 provide DC voltage to the circuitry, and three-position switch 112 provides the resistance control through the solenoid control switch 66 mounted within the console.

A plurality of reed switches control the extension or retraction of the pneumatic cylinders on the port side, as well as on the starboard side, as indicated on port side reed switches 114 and starboard side 116. A plurality of timers 118 control the period of activation of the solenoid valves 120 and in response thereto, the compressor 122. Depending upon the selective positioning of control switch 112, once the compressor has been turned on, the pneumatic circuitry is enabled and pressurized, in accordance with the schematic of FIG. 11, described hereinafter.

Upon enablement of the emergency activation switch, jack stands 124 are activated, and provide the emergency support for the suspension deck.

Figure 11:
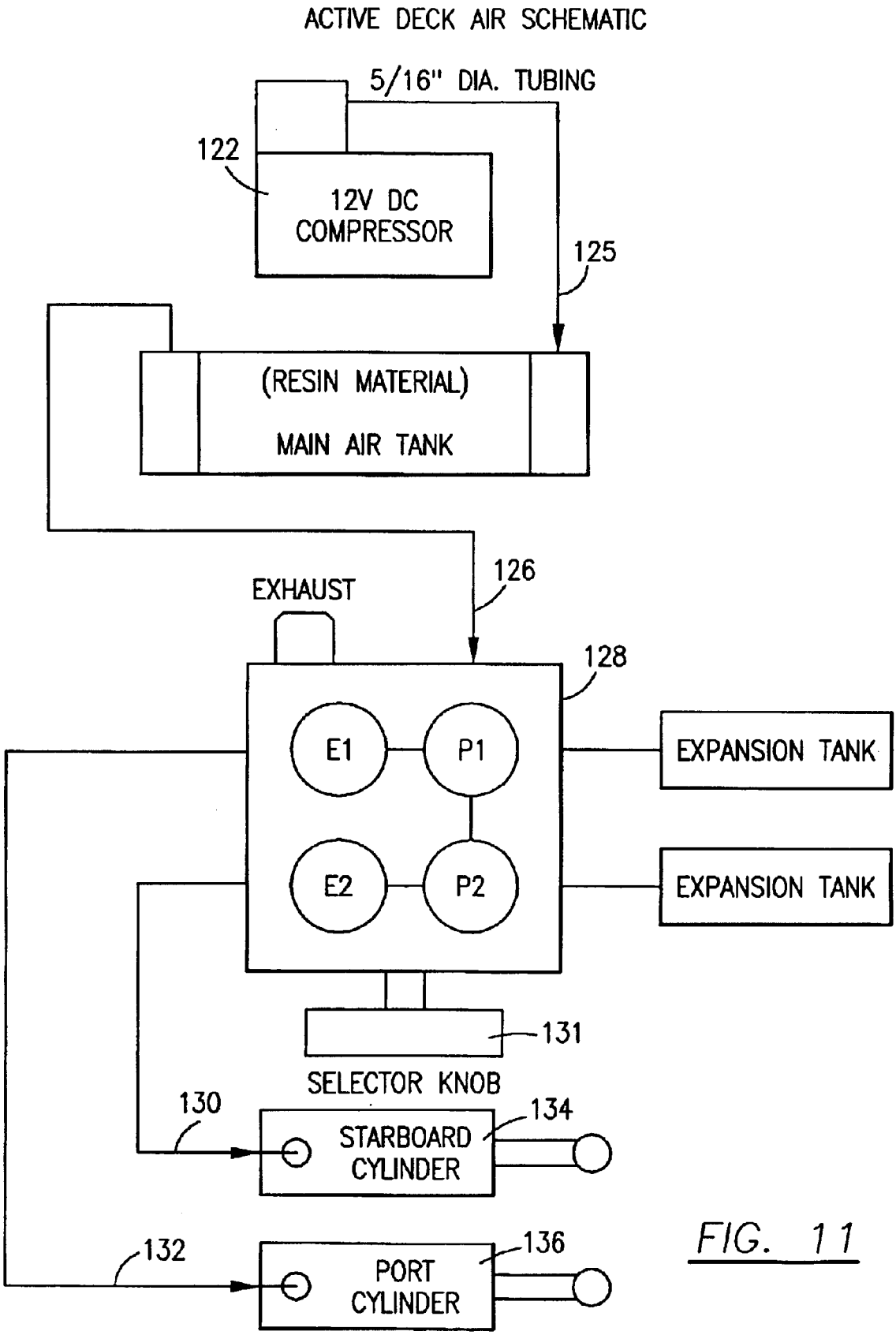
FIG. 11 is a pneumatic schematic of the instant invention.

The pneumatic control devices and conduit configuration are shown in FIG. 11, including compressor 122. The compressor supplies an input 125 to a main air tank, and from the main air tank input 126 to the pneumatic cylinder control device 128. Depending upon the positioning of the selector knob 131, which determines the relative stiffness of the suspension system, pneumatic pressurized inputs 130 and 132 are provided to starboard cylinder 134 and port cylinder 136.

A typical pneumatic control device which can be included in the suspension system would be a unitary device with four internal and independent solenoid valves. This allows the selection of the pressurized source at the desired level or intensity, and also controls the relative output for the starboard and port cylinders.

Figure 12:
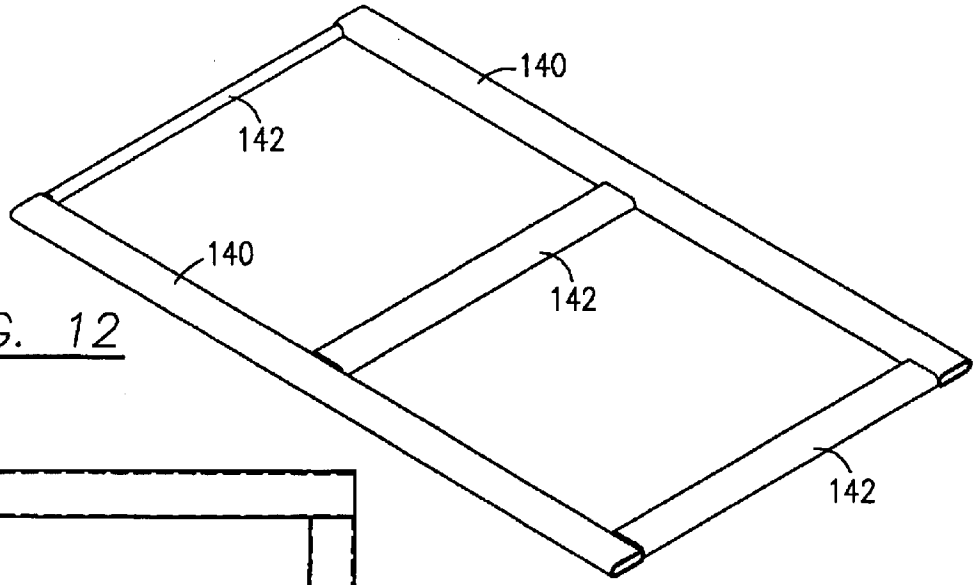
FIG. 12 is a perspective view, illustrating the frame support for the suspended deck of the instant invention.
Figure 12C:
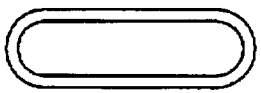
FIG. 12C is a cross-sectional view of a frame component of the instant invention.
Figure 12A:
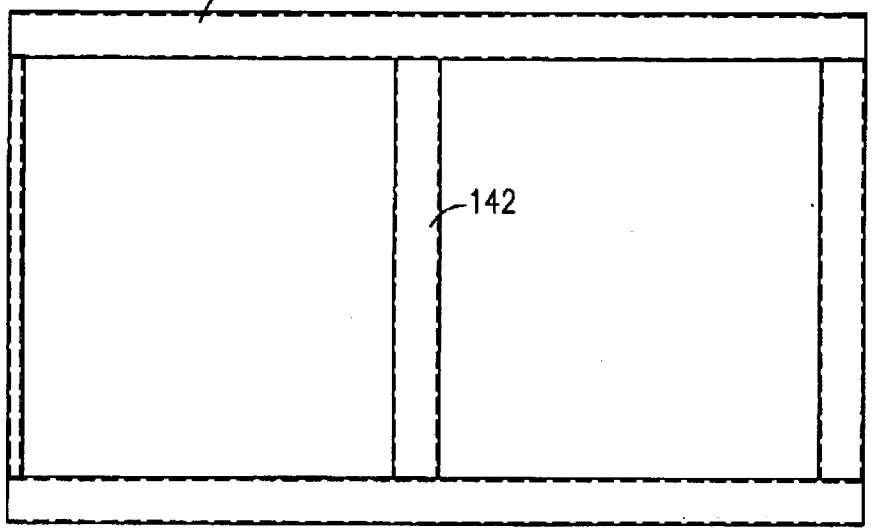
FIG. 12A is a top plan view of the invention disclosed in FIG. 12.
Figure 12B:
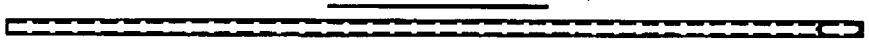
FIG. 12B is a front view of the invention disclosed in FIG. 12A.

Any suitable frame structure can be used to mount the suspension deck. For example, FIG. 12 illustrates a relatively simple frame structure, with sides 140 and intermediate support arms 142. The cross-section of the support arms can have an oval shape, as shown in FIG. 12C.

Figure 13B:
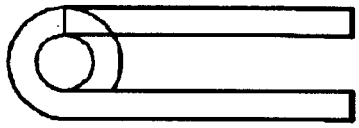
FIG. 13B is a side plan view of the hinge illustrated in FIG. 13A.
Figure 13A:
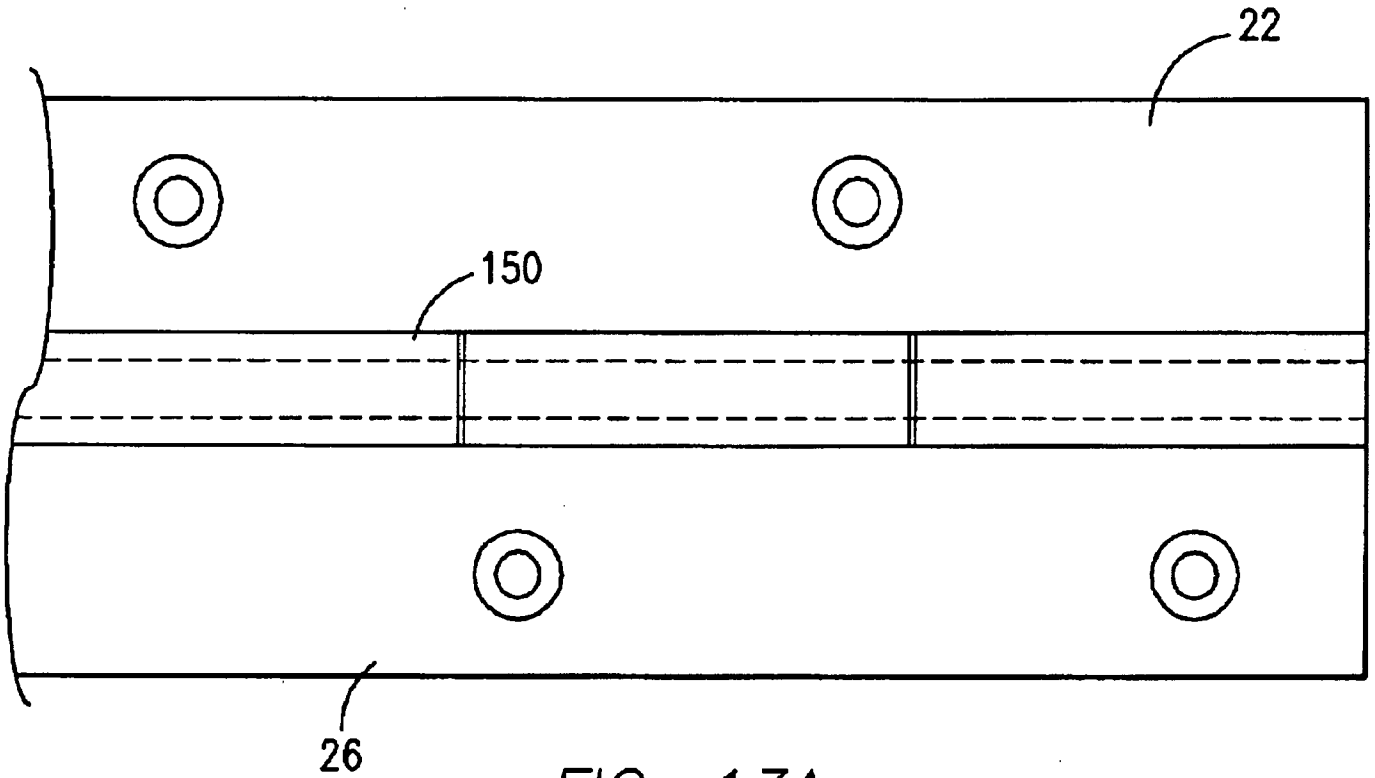
FIG. 13A is a top plan view of a section of the hinge assembly of the instant invention.

Finally, FIG. 13A includes a hinge assembly 150, which is shown in cross-section in FIG. 13B. The pivoting assembly or hinge provides a movable connection and interface between conventional deck 22 and suspension deck 26, as shown.

The various components in the instant invention can be manufactured using high-grade, heavy-duty aluminum components and extrusions. Alternatively, stainless steel can be used, or a variety of other material components and composites.

It will be seen that the objects set forth above, and those made apparent from the foregoing description, are efficiently attained, and certain changes may be made in the engineering, design, and construction without departing from the scope of this invention. It is intended that the foregoing description, examples, and designs shown in the accompanying drawings shall be interpreted as illustrative, and not in a limiting sense.

The instant invention has been shown and described herein in what is considered to be the most practical and preferred embodiment and alternative embodiments thereof. It is recognized, however, that departures may be made therefrom within the scope of the invention and that obvious modifications will occur to persons of ordinary skill in the art.

What is claimed is:

1. An active deck suspension system for use in marine vessels having a hull and an operator deck, comprising:

chassis means for mounting said system within said hull;

deck means for providing a moveable platform, said deck means at least partially supported by said chassis means; and dampening means for absorbing impact forces acting upon said hull and deck means, said dampening means mounted within said chassis means;

whereby, a suspended deck area provides improved vessel performance and occupant ride by reducing the effects of undesirable external forces.

2. The apparatus of claim 1, further comprising:

torsion control means for limiting movement of said deck means, said torsion control means mounted within said chassis means.

3. The apparatus of claim 1, further comprising:

auxiliary support means for securing said deck means, said auxiliary support means mounted within said chassis means.

4. The apparatus of claim 1, further comprising:

system control means for enabling and selectively adjusting the magnitude of said dampening means;

said system control means further including monitoring means for detecting loads acting upon said deck means, and automatically adjusting said dampening means in response thereto.

5. The apparatus of claim 1, wherein said chassis means comprises a deck support member, said deck means being secured thereto;

said chassis means further including a base support member, said base support member being secured within said hull;

said dampening means interposed said deck support member and said base support member.

6. The apparatus of claim 5, wherein said base support member is generally configured to complement the geometry of said hull, and mate thereto.

7. The apparatus of claim 5, wherein said deck support member and said base support member are generally coplanar, said chassis means being vertically and transversely mounted within said hull.

8. The apparatus of claim 1, wherein said dampening means comprises at least one pneumatic cylinder.

9. The apparatus of claim 1, wherein said dampening means comprises a plurality of pneumatic cylinders.

10. The apparatus of claim 2, wherein said torsion control means comprises a plurality of plate members, said plate members being hingedly secured to one-another, and further being pivotally mounted within said chassis means.

11. The apparatus of claim 7, wherein said dampening means comprises a plurality of pneumatic cylinders, said cylinders being mounted diametrically opposed to one another on opposite ends of said deck support member and said base support member;

and further wherein said torsion control means comprises a plurality of plate members, said plate members being hingedly secured to one-another, and further being pivotally mounted at the top to said deck support member and at the bottom to said base support member;

said plate members being interposed said pneumatic cylinders;

said plates maintaining coplanar alignment of said deck support member and base support member, and further preventing translational movement of said deck means.

12. An active deck suspension system, for use in marine vessels having a hull and an operator deck, comprising:

a generally vertical chassis having an upper deck support member and a lower base support member;

said deck support member and said base support member being coplanar and spaced apart from one-another;

said deck support member being generally horizontal, said base support member being of a semi-V configuration to complement, and mate to, said hull shape and being secured thereto;

a plurality of dampening cylinders, said dampening cylinders being interposed said deck support member and said base support member and coplanar thereto, said dampening cylinders being mounted diametrically opposed to one another on opposite ends of said deck support member and said base support member;

said dampening cylinders absorbing impact forces acting upon said hull or deck, said dampening cylinders being selectively extendable and retractable;

a suspension deck, said suspension deck having a fore section and an aft section, said suspension deck being integral with said vessel deck and generally flush therewith;

said suspension deck fore section securedly and removably fastened to said deck support member, said suspension deck aft section being hingedly secured to said vessel deck;

wherein, said dampening cylinders absorb loads, wave energy, and impact forces acting upon either the suspension deck or boat hull, providing for greater occupant stability and comfort when operating said vessel in rough seas or encountering undesirable objects.

* * * * *